United States Patent [19]

Brueske

[11] Patent Number: 4,559,753

[45] Date of Patent: Dec. 24, 1985

[54] METHOD OF INSTALLING A PREFABRICATED CURB UNIT TO A STANDING SEAM ROOF

[75] Inventor: Ralph H. Brueske, Kansas City, Mo.

[73] Assignee: Butler Manufacturing Company, Kansas City, Mo.

[21] Appl. No.: 704,517

[22] Filed: Feb. 22, 1985

Related U.S. Application Data

[62] Division of Ser. No. 431,046, Sep. 30, 1982.

[51] Int. Cl.[4] ..... E04B 1/00

[52] U.S. Cl. ..... 52/748; 52/200; 52/518

[58] Field of Search ..... 52/748, 200, 199, 520, 52/521, 537, 547, 549, 518; 98/42 R, 478

[56] References Cited

U.S. PATENT DOCUMENTS

| | | | |
|---|---|---|---|
| 3,521,414 | 7/1970 | Malissa | 52/200 X |
| 3,828,494 | 8/1974 | Uhshane et al. | 52/537 |
| 4,014,148 | 3/1977 | Harter | 52/537 |
| 4,168,596 | 9/1979 | Yoder, Jr. | 52/748 X |
| 4,348,846 | 9/1982 | Bellem | 52/520 X |

FOREIGN PATENT DOCUMENTS

| | | | |
|---|---|---|---|
| 1509121 | 5/1969 | Fed. Rep. of Germany | 52/200 |
| 2444280 | 3/1976 | Fed. Rep. of Germany | 52/199 |
| 2856835 | 7/1980 | Fed. Rep. of Germany | 52/200 |
| 145241 | 7/1920 | United Kingdom | 52/200 |

*Primary Examiner*—Carl D. Friedman

*Attorney, Agent, or Firm*—Shoemaker and Mattare, Ltd.

[57] ABSTRACT

A prefabricated curb unit is adapted to be seamed into the double lock standing seams used to interjoin roof panels forming an MR-24 ® roof manufactured by Butler Manufacturing Company.

9 Claims, 8 Drawing Figures

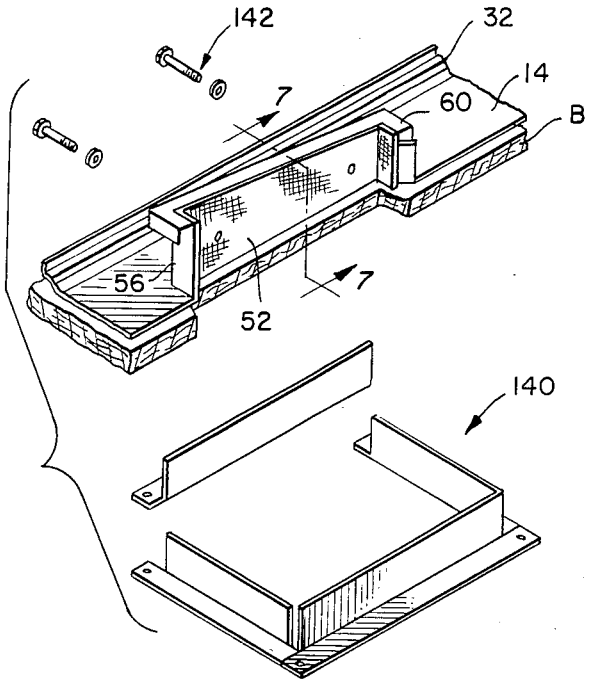
FIG. 6.
FIG. 7.
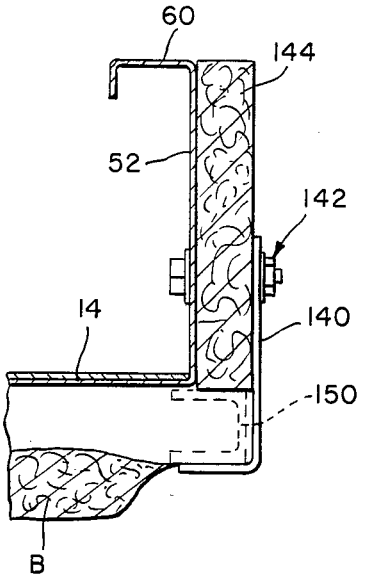
FIG. 8.
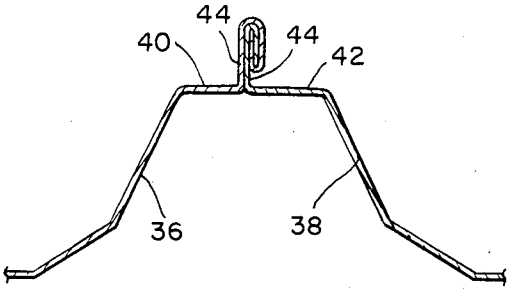

METHOD OF INSTALLING A PREFABRICATED CURB UNIT TO A STANDING SEAM ROOF

This is a division of application Ser. No. 431,046 filed Sept. 30, 1982.

BACKGROUND OF THE INVENTION

The present invention relates in general to building structures, and, more particularly, to roof structures.

Frequently, building equipment, such as fans, air conditioning units, or the like, are supported on the roof of a building. Such equipment requires installation of a roof curb unit.

Butler Manufacturing Company manufactures roof panels under the trademark MR-24. These roof panels are interlocked using a double lock standing seam.

Heretofore, there has been no roof curb unit available which is compatible with the Butler MR-24 ® roof in a prefabricated manner.

SUMMARY OF THE INVENTION

The roof curb unit embodying the teachings of the present invention is a prefabricated unit which can be seamed directly into the Butler MR-24 ® roof structure.

Such a roof curb unit is very watertight and presents a very high quality construction.

The curb unit of the present invention includes a welded and closed cricket. The cricket is an integral part of the curb walls and adds strength to the overall curb design. The cricket sheds water and eliminates water ponding on the upslope portion of the curb.

The curb walls and cricket are preferably 16 gauge GALVALUME material. A special welding procedure is used to join the cricket and curb walls to an MR-24 ® panel of a predetermined length. After welding, the curb and MR-24 ® panel become an integral unit.

The curb and MR-24 ® panel unit is placed on the roof according to a pre-roof layout plan, and is seamed into the MR-24 ® roof panel system, and thus becomes an integral part of the MR-24 ® roof system.

OBJECTS OF THE INVENTION

It is a main object of the present invention to provide a prefabricated roof curb unit for use with an MR-24 ® roof.

It is another object of the present invention to provide a prefabricated roof curb unit which efficiently sheds water.

These together with other objects and advantages which will become subsequently apparent reside in the details of construction and operation as more fully hereinafter described and claimed, reference being had to the accompanying drawings forming part hereof, wherein like reference numerals refer to like parts throughout.

BRIEF DESCRIPTION OF THE DRAWINGS

FIG. 6 is an exploded perspective showing the installation of the curb unit embodying the teachings of the present invention.

FIG. 7 is an elevation view taken along line 7—7 of FIG. 6.

FIG. 8 is an elevational view in cross-section of the double lock seam between panels.

DETAILED DESCRIPTION OF THE INVENTION

Figure 1:
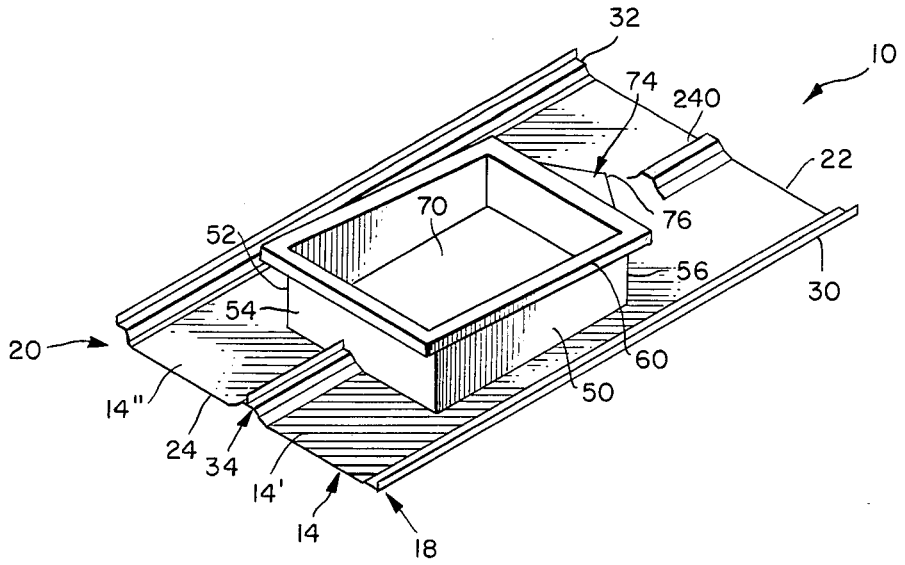
FIG. 1 is a perspective of a prefabricated curb unit embodying the teachings of the present invention.
Figure 2:
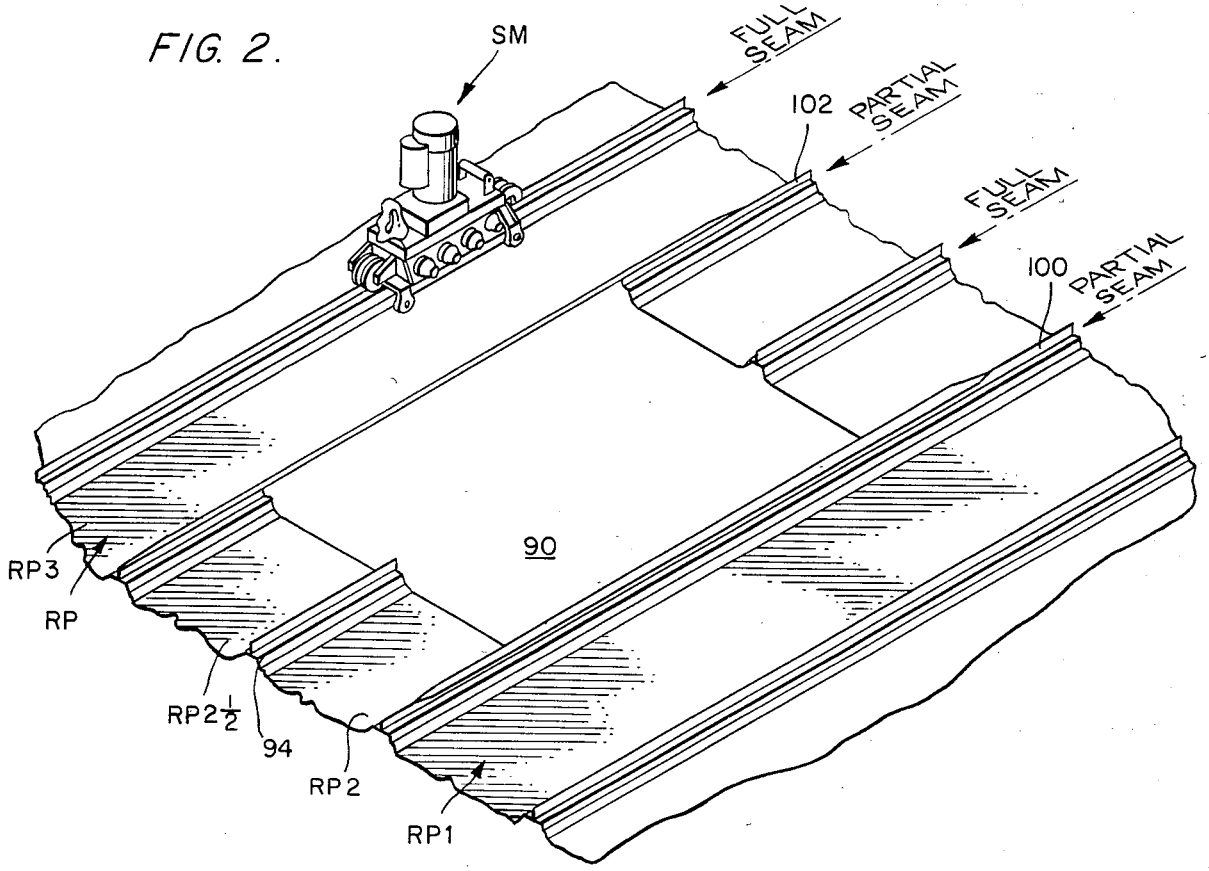
FIG. 2 is a perspective of an MR-24 ® roof prepared to receive the prefabricated curb unit shown in FIG. 1.

Shown in FIG. 1 is a prefabricated roof curb unit 10 which can be seamed into a roof panel, such as roof panel RP shown in FIG. 2, which preferably is part of an MR-24 ® roof manufactured by Butler Manufacturing Company. The roof includes building structural support means, such as purlins P, having a blanket B of insulation thereon and thermal spacer blocks SP on the insulation blanket (see FIG. 3). The roof panels RP are supported on the thermal spacer blocks and the insulation blanket. A full disclosure of such a system is contained in U.S. Pat. No. 4,348,846, issued on Sept. 14, 1982.

The roof curb unit 10 includes a one-piece elongate panel 14 having side edges 18 and 20 and end edges 22 and 24. The panel is part of an MR-24 ® roof, and includes seaming means 30, 32 and 34 which are located on each side edge and centrally of the panel, respectively. The panel 14 includes side edges 18 and 20, and has co-planar portions 14' and 14" extending between seaming means 30 and 32 and 32 and 34. Seaming means 30 and 32 are fully described in the just-referenced U.S. Pat. No. 4,348,846, the disclosure of which is fully incorporated herein by reference thereto. The MR-24 ® roof panels, and the mounting thereof, as by a seaming machine SM, such as a ROOF RUNNER ®, or the like, is also fully disclosed in U.S. Pat. No. 3,120,828.

As discussed in the just-referenced patent, the standing seams are all double lock standing seams. One of such seams is shown in FIG. 8.

The seaming means include sloping first sides 36 and sloping second sides 38 with shoulders 40 and 42 extending horizontally therefrom. An upstanding flange 44 is mounted on the shoulders to be incorporated into a roof seam when the roof panels are mounted. As discussed in the just-referenced patent, the roof panels are mounted on roof purlins with spacer blocks and blanket insulation providing thermal integrity to the roof. The interconnected panels are RP1, RP2, 2-½ and RP3 as shown in FIG. 2.

Figure 3:
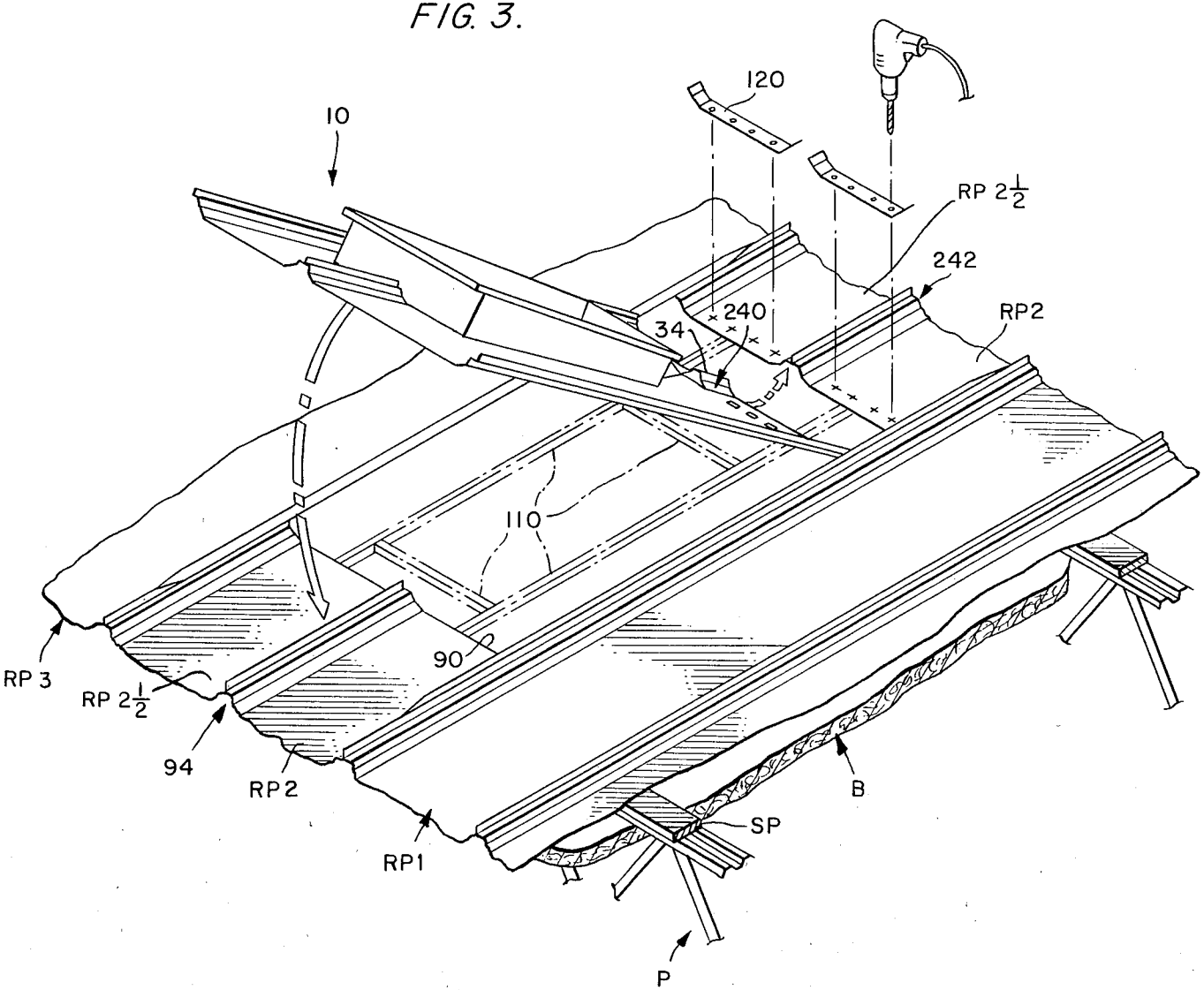
FIGS. 3 and 4 are perspective showings of the installation of a prefabricated curb unit into the MR-24 ® roof.

The roof curb unit 10 further includes a corrugation 240 located centrally thereof to be positioned beneath a panel seam 242 as best shown in FIG. 3.

The curb unit further includes a rim means welded to the panel to form an integral unit. The rim means includes a pair of side panels 50 and 52, a pair of end panels 54 and 56 and an L-shaped rim portion 60 surrounding curb opening 70 defined in the panel. A closed triangular cricket 74 is welded to end panel 56 of the curb rim means and serves as a water guide. The cricket has apex 76 located up-slope of the curb unit so water is shed from the curb unit.

Figures 4, 5:
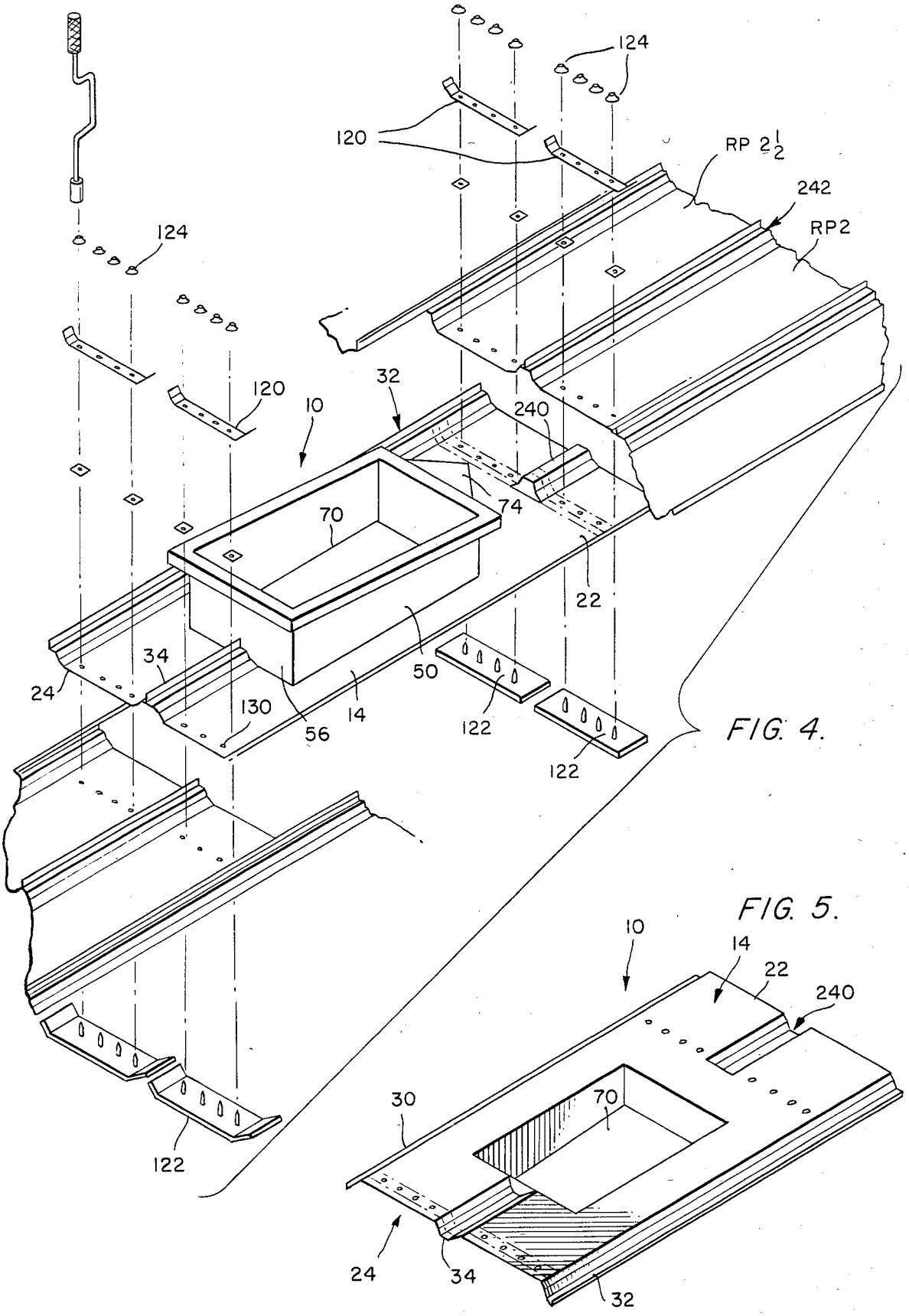
FIG. 5 is a perspective showing the underside of the curb unit shown in FIG. 4.

Referring to FIGS. 2, 3 and 4, installation of the curb unit into a roof panel system is easily understood. Two roof panels RP2, 2-½ have cut out opening 90 defined therein. The unit 10 is inserted into the cut out opening with leading end 22 positione beneath the up roof portions of panels RP2, 2-½ and aft end 24 positioned on top of the down roof portions of panels RP2, 2-½. The seaming means 34 is accommodated by a portion of the seam 94 connecting panels RP2-½ and RP2, and on top of the continuation of that seam. As best shown in FIG. 2, all seams are full seams, except seams 100 and 102, which are partial seams and accommodate the seaming means 30 and 32, respectively, to interjoin the curb unit with panels RP1, RP2, 2-½ and RP3. The partial seams are shown in FIG. 2 to be incompletely folded over, that is, the double lock stops at the location whereat the curb ends join the roof panel seams. The double lock seam is located at all other locations, however.

Appropriate support channels 110 can be mounted on the purlins to further support the curb, if suitable.

Suitable attaching means, such as straps 120, splice plates 122 and fasteners 124 are used to attach the curb unit to the panels RP2, RP2-½. As discussed in referenced U.S. Pat. No. 4,348,846, as to use of gauges 200,201, the panel straps themselves can be used as templates to appropriately mark the roof panels. These straps can also be used to appropriately mark the curb as well. Field holes 130 can be located and drilled.

Insulation can also be included in the curb unit as best shown in FIGS. 6 and 7. An insulation collar 40 is attached by fasteners, such as bolts 142, or the like, to the curb sides and ends as indicated in FIGS. 6 and 7.

Insulation 144 is positioned between the collar and the curb, and the collar is attached to the roof insulation B by a channel 150, or the like. Insulation 144 can be rigid, if suitable. The collar can be one-piece, or a plurality of interjoined pieces, as desired, and as indicated in FIG. 6.

After the curb is installed, sealant can be used to insure proper sealing around the curb.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A method of installing a roof curb with a roof having standing seams between adjacent roof panels comprising:

installing a plurality of roof panels having edges arranged for interlocking by seaming;

seaming interlocked edges of said roof panels over most of the roof except for the edges adjacent an area to be cut out;

cutting an opening at said area;

installing a roof curb peripheral extensions therewith into said opening; and completing the seaming of the partially seamed edges together with extensions of the roof curb for forming a solid, secure, watertight seal of the roof curb with the roof.

2. The method defined in claim 1, wherein said peripheral extensions include a leading edge extension, and including the further step of installing said leading edge extension under the up-slope side of said opening.

3. The method defined in claim 2, wherein said peripheral extensions include a trailing edge extension, and including the further step of overlaying this extension over the down-slope side of said opening.

4. The method defined in claim 3, including the further step of installing splice plates, straps and fasteners at each of the up slope and low slope areas of said curb extensions.

5. The method defined in claim 4, including the further steps of installing insulation and spacer blocks over roof purlins prior to laying said roof panels, and further installing insulation structure with the roof curb prior to installation thereof.

6. A method of installing a roof curb with a roof having standing seams between adjacent roof panels comprising:

installing a plurality of roof panels having edges arranged for interlocking by seaming;

seaming interlocked edges of said roof panels over most of the roof except for the edges adjacent an area which is left open;

installing a roof curb having peripheral extensions therewith into said open area; and completing the seaming of the partially seamed edges together with extensions of the roof curb for forming a solid, secure, watertight seal of the roof curb with the roof.

7. The method defined in claim 6, wherein said peripheral extensions include a leading edge extension, and including the further step of installing said leading edge extension under the up-slope side of said opening.

8. The method defined in claim 7, wherein said peripheral extensions include a trailing edge extension, and including the further step of overlaying this extension over the down-slope side of said opening.

9. The method defined in claim 8, including the further step of installing splice plates, straps and fasteners at each of the up slope and low slope areas of said curb extensions.

* * * * *